US005783986A

United States Patent [19]

Huang

[11] Patent Number: 5,783,986

[45] Date of Patent: Jul. 21, 1998

[54] PLUG WITH SECURITY DEVICE HAVING BIMETAL AND RESTORING BUTTON

[76] Inventor: Tse Chuan Huang, 1Fl., 16, Sublane 39, Lane 30, Wan Li St., Taipei, Taiwan

[21] Appl. No.: 570,934

[22] Filed: Dec. 12, 1995

[51] Int. Cl.[6] ..... H01H 37/70

[52] U.S. Cl. ..... 337/348; 337/66; 337/68; 337/333

[58] Field of Search ..... 337/66, 68, 248, 337/333, 343, 348, 380; 439/622, 246; 361/105

[56] References Cited

U.S. PATENT DOCUMENTS

| | | | |
|---|---|---|---|
| 4,379,278 | 4/1983 | Kuczynski et al. | 337/68 X |
| 4,518,943 | 5/1985 | Giessner | 337/68 |
| 5,248,954 | 9/1993 | Chiang | 337/66 |
| 5,526,225 | 6/1996 | Wang | 361/643 |

*Primary Examiner*—Michael W. Phillips
*Assistant Examiner*—Jayprakash N. Gandhi
*Attorney, Agent, or Firm*—Bacon & Thomas

[57] ABSTRACT

A plug with security device, including a housing, several conductive insertion plates adapted to be inserted into a power socket, conductive wires connected to an electric appliance and a security device. The insertion plates are connected with the conductive wires in the housing. The security device is disposed between at least one insertion plate and one conductive wire and includes a casing, a disconnector seat disposed therein, a thermal bimetal blade disposed on the disconnector seat, a movable contact disposed on the bimetal blade, a fixed contact disposed in the casing and connected with the conductive wire to naturally contact with the movable contact, and an insulative separating structure. When an excessively large current passes through the electric appliance, the bimetal plate is bent to separate the movable contact from the fixed contact and open the circuit. At this time, the insulative separating structure is inserted into a space between the movable and fixed contacts so as to keep the circuit open.

7 Claims, 4 Drawing Sheets

PLUG WITH SECURITY DEVICE HAVING BIMETAL AND RESTORING BUTTON

BACKGROUND OF THE INVENTION

The present invention relates to a plug with security device, and more particularly to a plug including a security device disposed between at least one conductive insertion plate and one conductive wire of the plug. When an excessively large current passes through an electric appliance, the security device automatically opens the circuit so as to protect the electric appliance and ensure safety.

Conventionally, a current-limiter such as a fuse or a disconnector is added to a circuit to shut off the current in the case of excessively large current. With respect to the fuse, once it is burned down, a new one must be replaced therefor. It is quite inconvenient for the user to replace the fuse so that the use of the fuse has been gradually reduced. With respect to the disconnector, the structure thereof is relatively complicated and the price thereof is higher. Therefore, it is uneconomical to use the disconnector and it is difficult to install the disconnector on the circuit. As a result, it happens frequently that several circuits with smaller current specification commonly use one disconnector with larger current specification so as to save the cost and facilitate the installation. However, such disconnector will inevitably have a relatively low sensitivity.

A conventional plug has several conductive insertion plates at a front end (the number of which is determined by the power source pattern) and several corresponding conductive wires at a rear end connected with the insertion plates in a housing respectively. In use, the insertion plates are inserted into a power socket which supplies power to the electric appliance. According to such arrangement, the plug is equipped with no protective or security device. Therefore, in case the electric appliance abnormally works the disconnector cannot be operated to shut off the current, and an excessively large current may still pass through the electric appliance to damage the same or even cause danger. As a result, the safety in using electricity cannot be ensured and accidents still take place frequently.

SUMMARY OF THE INVENTION

It is therefore a primary object of the present invention to provide a plug with a security device, including a security device disposed between at least one conductive insertion plate and one conductive wire of the plug. The security device includes a thermal bimetal blade, a movable contact disposed on the bimetal blade and a fixed contact naturally contacting with the movable contact. When an excessively large current passes through the electric appliance, the bimetal plate is bent to separate the movable contact from the fixed contact and automatically open the circuit so as to shut off the current and avoid burning down of the electric appliance or accident.

It is a further object of the present invention to provide the above plug in which when the movable contact is separated from the fixed contact, an insulative separating board is inserted into a space between the movable and fixed contacts so as to keep the circuit open. After the malfunction is eliminated, a lever arm is depressed to push the separating board away from the space, permitting the movable contact to contact with the fixed contact again so as to re-close the circuit. While having a more accurate operation, the structure of the plug is simple and the cost thereof is lower.

The present invention can be best understood through the following description and accompanying drawings, wherein:

DETAILED DESCRIPTION OF THE PREFERRED EMBODIMENTS

Figure 1:
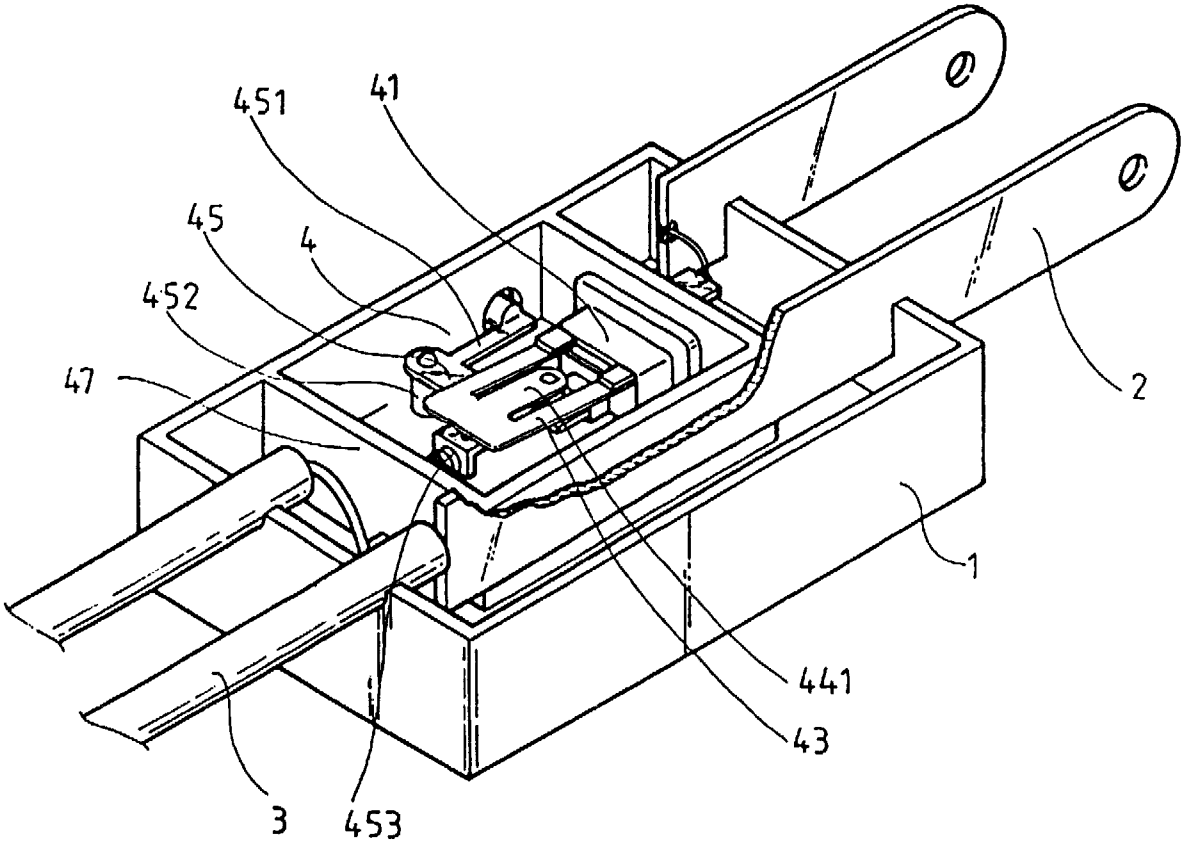
FIG. 1 is a perspective view of a first preferred embodiment of the present invention.
Figure 2:
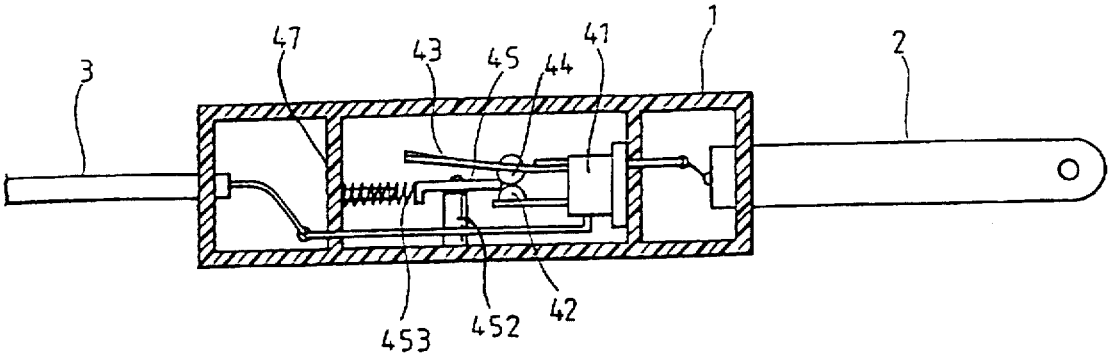
FIGS. 2 and 3 are side sectional views of the first preferred embodiment according to FIG. 1.
Figure 3:
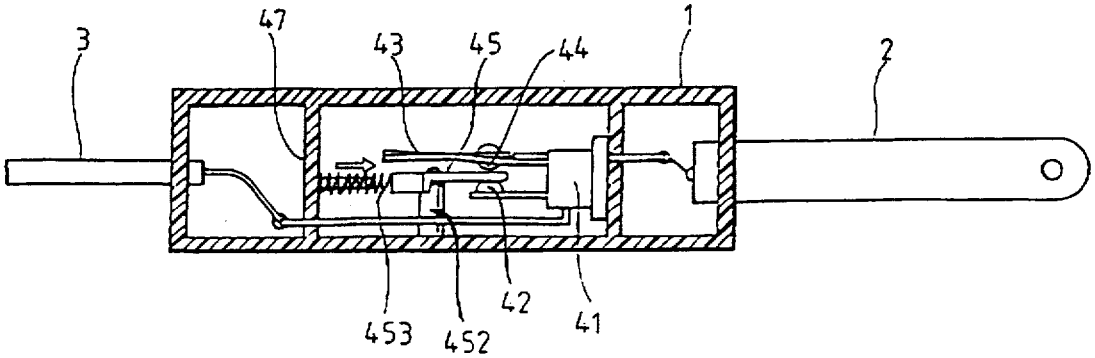
Figure 4:
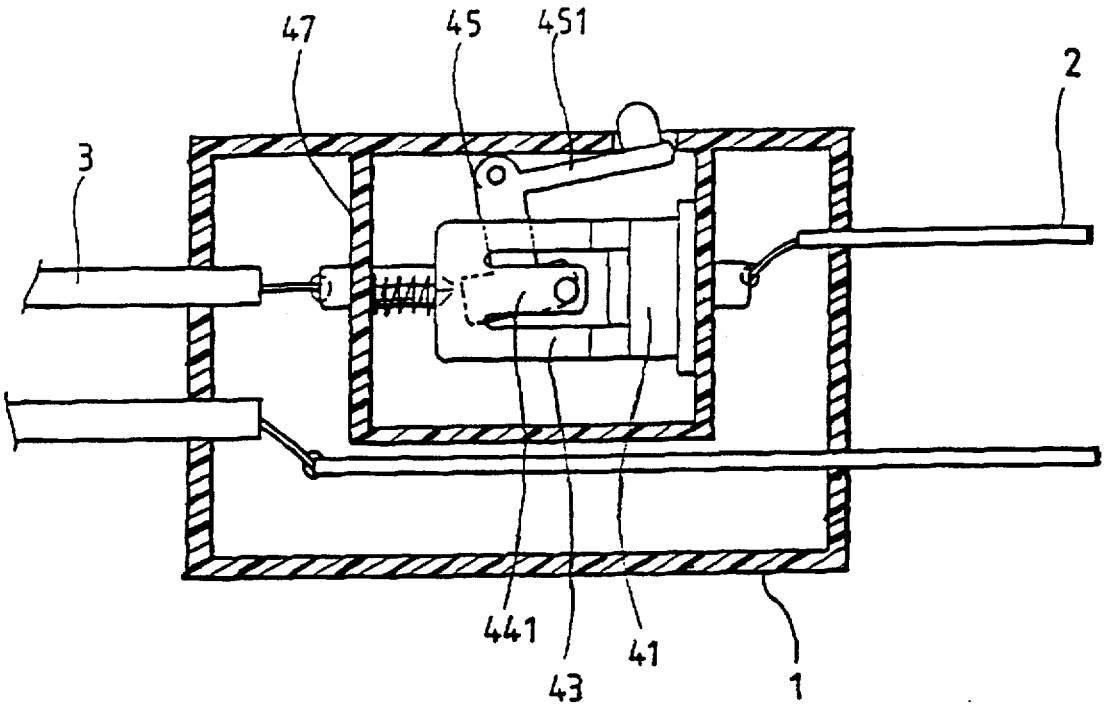
FIGS. 4 and 5 are top sectional views of the first preferred embodiment according to FIG. 1.
Figure 5:
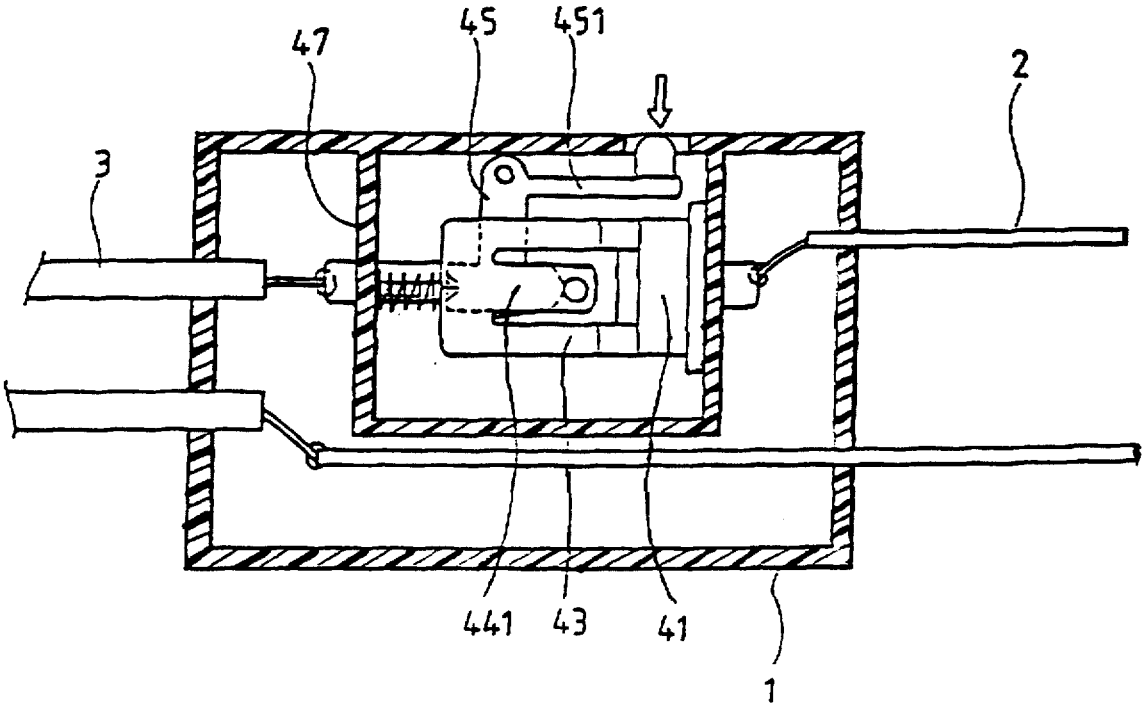

Please refer to FIGS. 1 to 5. According to a first embodiment of the present invention, the plug of the present invention includes a housing 1, a pair of conductive insertion plates 2, conductive wires 3 and security device 4. The insertion plates 2 are respectively connected with the conductive wires 3 in the housing 1. The security device 4 is disposed between at least one insertion plate 2 and one conductive wire 3. The security device 4 includes a casing 47 and a disconnector seat 41 disposed therein. A thermal bimetal blade 43 is disposed on the disconnector seat 41 and connected with the insertion plate 2. The bimetal blade 43 has two lateral portions integrally associated with each other at front ends and a middle resilient plate 441. A movable contact 44 is disposed at a rear end of the resilient plate 441. A fixed contact 42 is disposed in the casing 47 and connected with the conductive wire 3. The movable contact 44 naturally contacts with the fixed contact 42. A support seat 452 is disposed in the casing 47 to support a lever arm 451 which has one end extending out of the housing. The other end of the lever arm 451 is disposed with an insulative separating board 45 extending to one side of the two contacts. An extension spring 453 is disposed on a rear side of the separating board 45. In normally used state, the current flows from the socket to one of the insertion plates 2 through one of the wires 3 into an electric appliance and then flows from the electric appliance through the fixed contact 42, movable contact 44 and the bimetal blade 43 back to the socket.

In abnormally working state and when an excessively large current passes through the plug, the thermal bimetal blade 43 is bent due to the high temperature caused by the large current. At this time, the resilient plate 441 is displaced to make the movable contact 44 separate from the fixed contact 42 so as to open the circuit. Simultaneously, the separating board 45 is forced by the extension spring 453 to extend into a space between the two contacts. Therefore, the movable contact 44 is kept separated from the fixed contact 42 so as to ensure safety. Also, the lever arm 451 protrudes outside the housing 1. After the malfunction of the electric appliance is eliminated, the lever arm 451 is depressed to slide the separating board 45 out of the space between the contacts back to its home position. On the other hand, the bimetal blade 43 is restored to its original shape due to lack of current and thus the resilient plate 441 drives and restores the movable contact 44 to contact with the fixed contact 42 for normal use.

Figure 6:
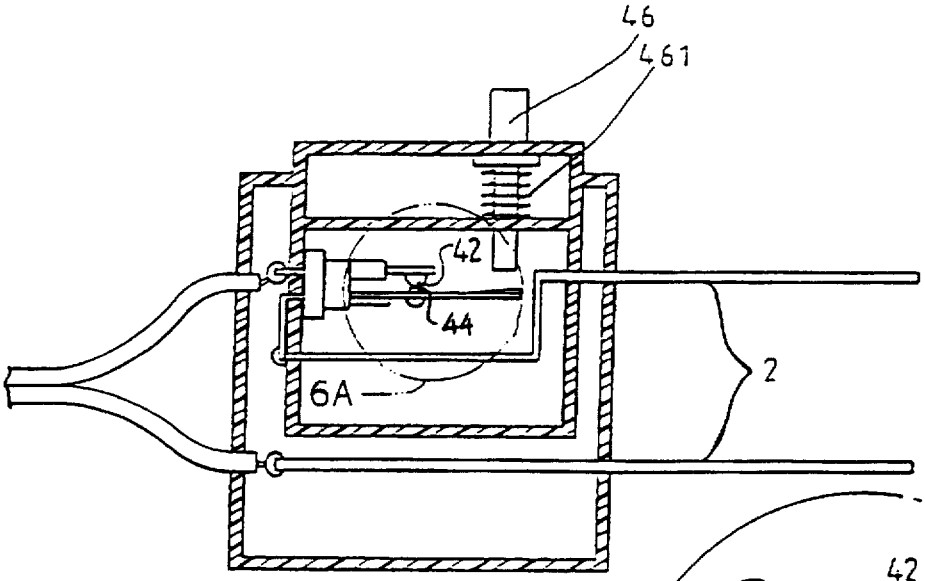
FIG. 6 is a side sectional view of a second preferred embodiment of the present invention.
Figure 6A:
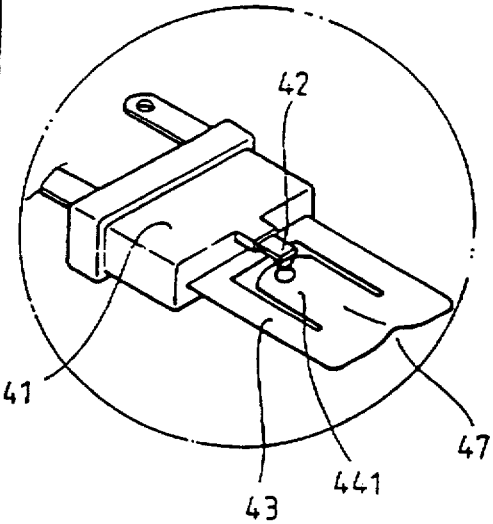
FIG. 6A is an enlarged view showing the bimetal blade of the second preferred embodiment according to FIG. 6.
Figure 7:
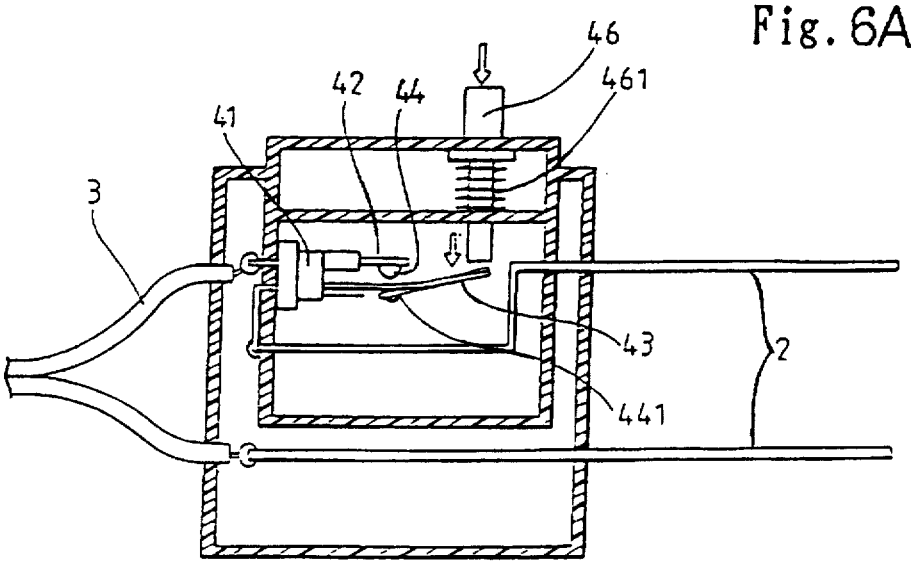
FIG. 7 is a side sectional view of the second preferred embodiment, showing that the bimetal blade is bent to separate the movable contact from the fixed contact.

FIGS. 6 and 7 show a second preferred embodiment of the present invention, wherein a disconnector seat 41 is disposed between at least one insertion plate 2 and one conductive wire 3. The disconnector seat 41 is disposed with a fixed contact 42. A thermal bimetal blade 43 is disposed under the fixed contact 42. The bimetal blade 43 has two lateral portions and a middle resilient plate 441. A bent portion 47 is formed at front end of the bimetal blade 43 and the resilient plate rearward extends from the bent portion 47 between the two lateral portion. A movable contact 44 is disposed at rear end of the resilient plate 441 to contact with the fixed contact 42. When an excessively large current passes through the electric appliance, the bimetal plate 43 is bent to separate the movable contact 44 from the fixed contact 42. At this time, by means of the bent portion 47, the bimetal blade 43 is kept bent and prevented from restoring to its original shape. Therefore, the circuit is kept open. After the malfunction is eliminated, a restoring button 46 is depressed to restore the bimetal blade 43 to its original shape for normal use. The restoring button 46 is restored to its home position by a compression spring 461.

In conclusion, the plug with security device of the present invention is able to prevent abnormal current from passing through an electric appliance so as to ensure safety and avoid accident.

The above description and drawings are only used to illustrate some preferred embodiments of the present invention, not intended to limit the scope thereof. Many modifications can be made without departing from the spirit of the present invention.

What is claimed is:

1. A plug with a security device, comprising:

a housing;

a plurality of electrically conductive insertion plates adapted to be inserted into a power socket extending from the housing;

conductive wires extending from the housing and connected to the insertion plates;

and a security device connected between at least one insertion plate and one conductive wire the security device including a disconnector seat disposed in the housing, a thermal bimetal blade connected to the disconnector seat and electrically connected to the at least one insertion plate, the bimetal blade having two lateral portions and a middle portion integrally associated with each other at first ends and a resilient plate extending from the middle portion, a movable contact located on an end of the resilient plate, a fixed contact located on the disconnector seat and electrically connected with said one conductive wire, whereby the movable contact normally is in a first position in electrical contact with the fixed contact, the middle position comprising a bent portion, whereby, when a current above a predetermined value passes through the plug, the bimetal plate bends to a second position wherein the movable contact is out of contact with the fixed contact the bent portion keeping the bimetal blade in the second position until acted upon by a restoring force.

2. The plug with a security deice as claimed in claim 1, further comprising a restoring button located beside the movable contact and movable so as to apply a restoring force to the bimetal blade to restore the bimetal blade to the first position and bring the movable contact into electrical contact with the fixed contact.

3. The plug with a security device as claimed in claim 2, further comprising a resilient member acting on the restoring button so as to urge the restoring button to a first position.

4. A plug with a security device, comprising:

a housing;

a plurality of electrically conductive insertion plates adapted to be inserted into a power socket;

a plurality of conductive wires connected to the insertion plates in the housing; and a security device disposed between at least one insertion plate and one conductive wire, the security device including a casing, a disconnector seat located in the casing, a thermal bimetal blade connected to the disconnector seat, a movable contact located on the bimetal blade, a fixed contact disposed in the casing and connected with one of the plurality of conductive wires, the fixed and movable contacts normally being in electrical contact with each other and an insulating separating board having a substantially planar configuration and pivotally mounted in the casing so as to pivot about an axis extending substantially perpendicular to the plane of the insulating board, the insulating board having a lever arm with a distal end extending externally of the housing, whereby the insulating base is movable between a first position wherein the insulating board is located between the movable and fixed contacts to prevent electrical contact between the movable and fixed contacts, and a second position wherein the insulating board is not located between the movable and fixed contacts, the insulating board remaining in the first position until a restoring force acts on the lever arm to move the insulating board to the second position, whereby when a current above a predetermined value passes through the plug, the bimetal plate bends to separate the movable contact from the fixed contact enabling the insulating separating board to be moved to the first position between the movable and fixed contacts.

5. The plug with a security device as claimed in claim 4, wherein the bimetal blade comprises two integral lateral portions connected with each other at front ends and a middle portion with a rearwardly extending resilient plate, the movable contact being located on a rear end of the resilient plate.

6. The plug with a security device as claimed in claim 4, wherein the insulating separating board is pivotally attached to a support seat disposed in the casing.

7. The plug with a security device as claimed in claim 6, further comprising a spring acting on the insulating separating board to urge the insulating separating board toward the first position.

* * * * *